US008087217B2

(12) United States Patent
Fortunato

(10) Patent No.: US 8,087,217 B2
(45) Date of Patent: Jan. 3, 2012

(54) METHOD AND A DEVICE FOR FORCIBLY EXPELLING A CORK FROM A BOTTLE OF CHAMPAGNE OR THE LIKE

(76) Inventor: Marc Fortunato, Ahuy (FR)

( * ) Notice: Subject to any disclaimer, the term of this patent is extended or adjusted under 35 U.S.C. 154(b) by 134 days.

(21) Appl. No.: 12/521,182

(22) PCT Filed: Feb. 13, 2008

(86) PCT No.: PCT/FR2008/000179

§ 371 (c)(1),
(2), (4) Date: Jun. 25, 2009

(87) PCT Pub. No.: WO2008/119896

PCT Pub. Date: Oct. 9, 2008

(65) Prior Publication Data

US 2010/0287894 A1 Nov. 18, 2010

(30) Foreign Application Priority Data

Feb. 13, 2007 (FR) ..... 07 00997

(51) Int. Cl.
*B67B 7/02* (2006.01)

(52) U.S. Cl. ..... 53/492; 53/381.1; 53/381.4

(58) Field of Classification Search ..... 53/492, 53/381.1, 381.4
See application file for complete search history.

(56) References Cited

U.S. PATENT DOCUMENTS

| | | | | | |
|---|---|---|---|---|---|
| D82,679 | S | * | 12/1930 | Hutcheson | D9/441 |
| D201,395 | S | * | 6/1965 | Schmidt | D9/668 |
| 3,192,803 | A | * | 7/1965 | Federighi | 81/3.2 |
| 4,319,753 | A | * | 3/1982 | Mann | 473/133 |
| 4,527,450 | A | * | 7/1985 | Drosky | 81/3.29 |
| 4,680,993 | A | * | 7/1987 | Feliz | 81/3.37 |
| 4,836,060 | A | * | 6/1989 | Klefbeck | 81/3.29 |
| 5,040,437 | A | * | 8/1991 | Mueller | 81/3.2 |
| 5,528,961 | A | | 6/1996 | Paramest | |
| D398,484 | S | * | 9/1998 | Duggan | D7/603 |
| 6,062,107 | A | | 5/2000 | Johnson | |
| 6,223,626 | B1 | * | 5/2001 | West | 81/3.48 |
| 7,658,130 | B1 | * | 2/2010 | Porteous | 81/3.09 |
| 2009/0133537 | A1 | * | 5/2009 | Uglum | 81/3.37 |
| 2011/0031208 | A1 | * | 2/2011 | Golden | 215/228 |

FOREIGN PATENT DOCUMENTS

EP 0 934 902 A1 8/1999

* cited by examiner

*Primary Examiner* — Christopher Harmon
(74) *Attorney, Agent, or Firm* — Haverstock & Owens

(57) ABSTRACT

The method consists in: a) screwing a spherical impact part (16) onto the body of the cork so as to extend it axially; b) orienting and holding the bottle (14) in a predetermined position such that the bottle extends below a reference level (18), the impact part (16) emerging above said level; and c) striking the impact part with a striker surface (22) situated at the end of the arm of a striker accessory (24), e.g. a golf club. This produces a sudden force on the cork of amplitude that is sufficient to forcibly expel the cork solely by the fact of striking against the impact part. The device further comprises a podium (10) defining the reference level (18) and means (30) for orienting and holding the bottle (14) in a predetermined position which may be vertical or inclined.

17 Claims, 3 Drawing Sheets

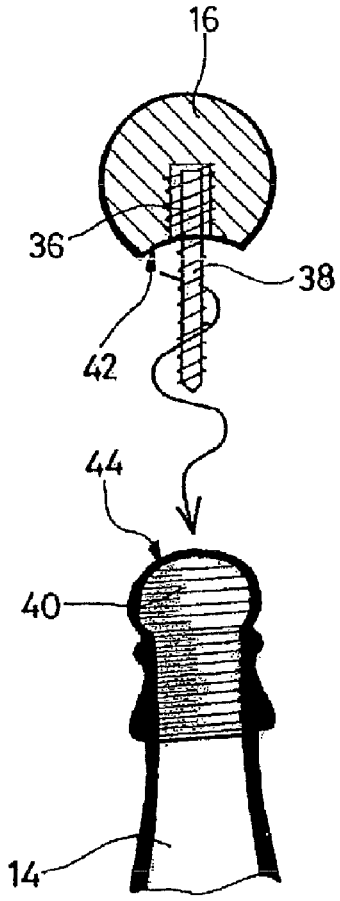
FIG_3
FIG_4
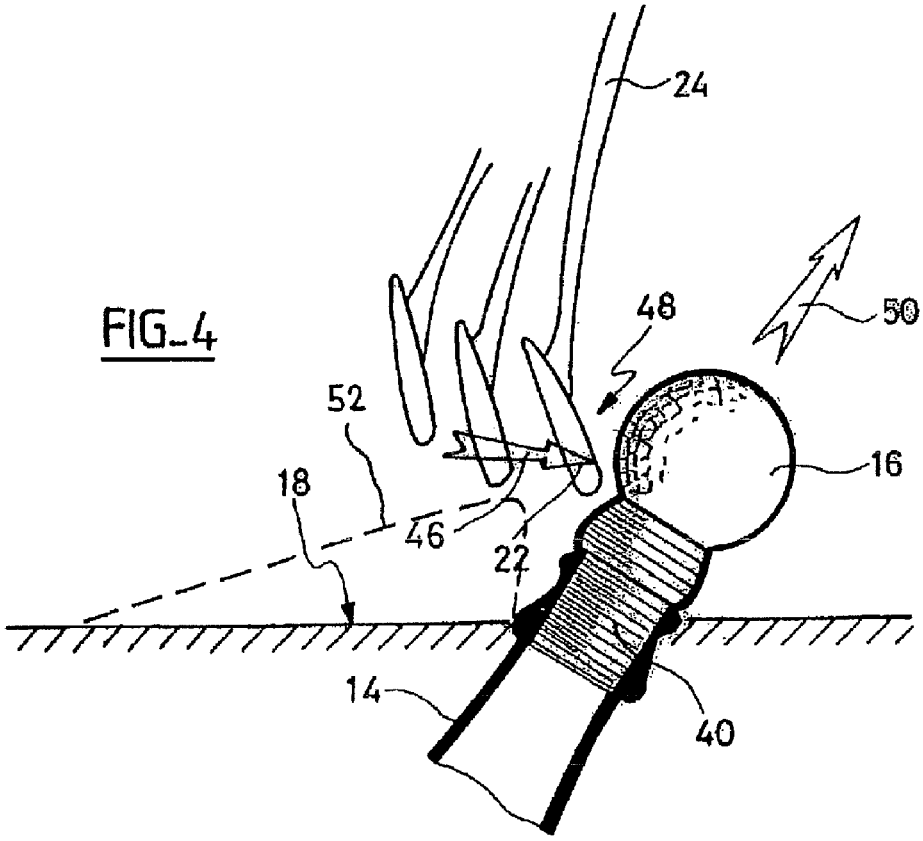

METHOD AND A DEVICE FOR FORCIBLY EXPELLING A CORK FROM A BOTTLE OF CHAMPAGNE OR THE LIKE

The invention relates to a method of expelling a cork from a bottle such as a bottle of champagne or of an analogous beverage (sparkling wines, effervescent and carbonated beverages, etc.), and it also provides a device for implementing the method.

Nevertheless, it should be observed that the invention is not limited in any way by the type of bottle or container, nor by the content thereof, and the invention can be applied to any type of beverage, regardless of whether it is carbonated or contained in a pressurized container (pressurized by means of a propellant gas).

The invention may even be applied to non-carbonated beverages contained in bottles or containers that are not pressurized, even though under such circumstances the effects produced by opening the bottle will be less spectacular.

The usual way of extracting a champagne cork or the like consists in exerting a combined traction and twisting force progressively until the thrust of gas causes the cork to be expelled. This action can be performed barehanded, or with the help of a clamp or some other accessory to get a better grip on the cork (as in FR-A-2 878 514) or to increase the level of force by means of a lever system (as in U.S. Pat. Nos. 5,528,961 and 6,062,107).

Another known technique consists in "cracking" the bottle open (as in EP-A-0 934 902) by using an article in the form of a blade to deliver a violent blow in an axial direction against the rim of the neck of the bottle. The impact gives rise to local stress that has the effect of breaking the neck of the bottle cleanly, so that the bottle is opened without the cork ever being extracted.

Essentially, the method of the invention consists in ejecting the cork by exerting a sudden and controlled force thereon (and not on the bottle) by using a striker accessory that is handled by the person in charge of opening the bottle, the force being transmitted via an impact part that has previously been secured to the cork.

More precisely, the method of the invention is characterized by the following successive steps:

a) securing an impact part to the body of the cork so as to extend the cork axially from the bottle;

b) orienting and holding the bottle in a predetermined position so that the bottle extends essentially below a reference level, with the impact part emerging above said level; and c) striking the impact part with a striker surface in such a manner as to produce a force of sufficient amplitude to forcibly expel the cork solely by the fact of the striker surface striking against the impact part.

The striker surface may be situated in particular at the end of the arm of a striker accessory, e.g. an accessory of the golf club type.

Incidentally, this technique presents the advantage of being extremely spectacular, thereby making it particularly appropriate for festive celebrations, for official trophy awarding ceremonies, etc.

The term "secure" is used herein to mean that a connection is established between the impact part and the cork that is both rigid—as described below—and deformable—e.g. by means of a cable having one end fastened to the cork and its other end to the impact part. Securing may also be achieved by using a one-piece structure comprising a cork and an impact part, or by using other variants as described below in the present application.

It is also specified that the term "cork" is used to cover not only a traditional stopper made of cork that is pushed into the neck of the bottle, but also closure means made of some other material (in particular plastics material or aluminum), or any other means serving to close the bottle in some other way.

In various particular implementations of the method, in step b), the bottle may be oriented so that its main axis is essentially perpendicular to the direction in which the striker surface strikes against the impact part, or else it may form an angle therewith lying in the range 90° to 45°.

The invention also provides an assembly for implementing the above method, the assembly comprising:

- an impact part suitable for axially extending the cork of the bottle and including means for securing it to the body of the cork; and
- a bottle support, comprising a podium defining a reference level and means for orienting and holding the bottle in a predetermined position such that it extends substantially below said reference level, with the impact part emerging above said level.

The term "podium" should be understood in a very general sense, and not only a raised plane platform as in the example described below, but also designating any plane or even curved surface (e.g. a gutter-shaped surf "rail"), with the reference level for striking being defined relative thereto.

The assembly may also include a striker accessory comprising an arm with the striker surface being located at the end thereof. In particular, the striker accessory may be an accessory of the golf club type.

The impact part preferably presents a shape that is essentially spherical. The means for securing it to the body of the cork may also comprise a self-drilling axial screw, advantageously with a spacer being interposed between the impact part and the body of the cork, around an intermediate region of the self-drilling screw.

In a variant, the impact part and the cork may be made as a single piece and/or with a cork that itself comprises two coaxial portions, specifically an outer portion in contact with the neck of the bottle and an inner portion suitable for being secured to the impact part.

In another variant, the cork is made in two portions that are united by a breakable element, a stationary first portion being secured to the neck of the bottle and a second portion suitable for being secured to said impact part so as to be ejected together therewith. Provision may optionally be made between the breakable element and the first portion for a region that includes means for securing to the first portion.

Finally, the assembly may also be provided with external means for pressurizing the volume inside the bottle.

There follows a description of an embodiment of the device of the invention given with reference to the accompanying drawings in which the same numerical references are used from one figure to another to designate elements that are identical or functionally similar.

FIG. 3 shows more precisely the impact part and the way in which it is secured to the cork of the bottle.

FIG. 4 shows the way in which the cork is expelled by the method of the invention.

Figure 1:
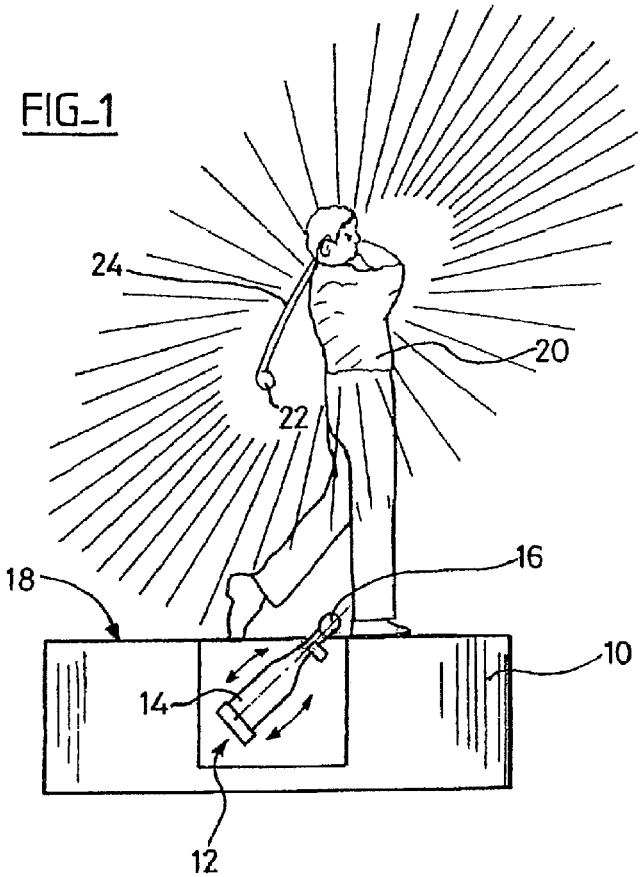
FIG. 1 is an overall view showing the arrangement of the various elements used for expelling the cork by the technique of the invention.

Implementing the method of the invention requires a combination of elements to be used, as shown overall in FIG. 1. A podium 10 includes a support 12 in which there is mounted a turnable support for receiving the bottle 14 for opening. The cork of the bottle is provided with an impact part 16, for example a spherical part having the size and the appearance of a golf ball, and situated a little above the horizontal surface 18 of the podium 10.

To proceed with opening, the user 20 stands on the podium and strikes the impact part 16 with the head 22 of a golf club 24 (an "iron" or a "wood"), thereby having the effect of simultaneously expelling the impact part 16 together with the cork that is secured thereto.

The podium 10 occupies an area of about 1 square meter ($m^2$) so as to enable the user 20 to take up a correct position relative to the impact part 16. It also presents a minimum height of about 35 centimeters (cm) that is sufficient to ensure that the bottle, with the exception of its neck, lies essentially below the top surface 18 of the podium. The side wall of the podium may also be used to carry advertising or information messages.

Figure 2:
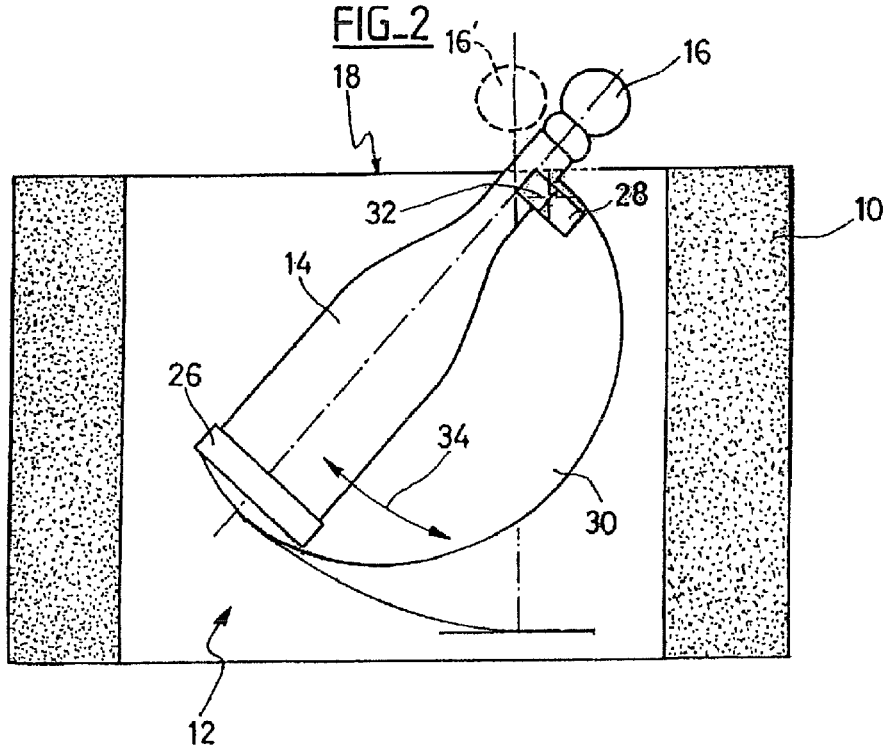
FIG. 2 is an enlarged view showing the bottle support.

FIG. 2 shows in greater detail the structure of the bottle support means 12. They comprise a base 26 designed to hold the bottom of the bottle 14, and a support 28 receiving the neck of the same bottle, while preventing it from moving upwards, given the way the flare of the neck comes into abutment against the support 28. The base 26 and the support 28 are mounted on rotary equipment 30 enabling the angle of inclination of the bottle to be varied so that its longitudinal axis forms an angle lying in the range 30° to 90° relative to the horizontal (45° in the example shown in FIG. 2). The pivot axis 32 of the rotary equipment 30 is placed so as to minimize variations in the height of the impact part 16 relative to the reference level 18 (top surface of the podium 10) in the various different positions that it is capable of taking up.

Clearly by modifying the adjustment of the support, the user can select whether to strike the impact part 16 with the bottle in an inclined position (as shown in continuous lines in FIG. 2), or with the bottle in a vertical position and with the impact part (shown in dashed at 16') being located at substantially the same height relative to the reference plane 18 as when the bottle is inclined.

For left-handed users, it is appropriate to turn the podium round and reverse the positions of the support 12 and of the moving part 30 so as to offer an inverse configuration.

It should be observed that the particular support shown is merely one example amongst others, and that numerous embodiments can be envisaged, providing it is possible to place the bottle with the desired orientation and hold it in that orientation, together with the impact part situated at the correct height relative to the horizontal plane 18. It is thus possible to engage the bottle directly in the podium, e.g. by placing it in a hollow receptacle of shape complementary to the shape of the bottle.

The example of striking by means of a golf club handled by a user standing on a podium is nevertheless not limiting in any way on the invention.

Firstly, depending on the sport concerned, the reference level (corresponding to the plane 18 of the podium in the example of FIGS. 1 and 2) may vary, depending on the level at which striking occurs. In golf, this level is at the same height as the plane on which the player's feet are standing, whereas in other sports such as polo the striking level is below foot level. Conversely, in sports such as tennis or baseball, the striking level is situated higher than the level of the player's feet.

Furthermore, the impact part may be struck not only by a striking surface situated at the end of a striking accessory (the golf club in the example of FIGS. 1 and 2), but also directly by a portion of the human body, for example the foot or the hand, providing the resulting impact is sufficient to force out the cork solely as a result of percussion against the impact part: for example a karateka or a footballer could use a hand or a foot respectively to strike an impact part secured to the cork so as to cause the cork to be expelled.

FIG. 3 shows an example of an impact part 16 secured to the cork 40 of the bottle 14.

In the example shown, the impact part 16 presents an outside appearance that is spherical, similar to that of a golf ball, and with dimensions that are comparable (diameter about 40 millimeters (mm)) and it is provided internally with an insert 36 that receives a double-threaded screw 38.

The emerging portion of the screw 38 is designed to be screwed into the body of the cork 40. For this purpose, the screw 38 is advantageously a self-drilling screw, suitable for being screwed by hand even through a metal capsule covering the top face of the cork. The screw 38 presents a diameter of the order of 6 mm to 8 mm, and the length of its emerging portion is of the order of 20 mm to 40 mm, which values suffice to provide a good compromise and ensure that, at the moment of impact, the neck does not break and the screw is not torn out of the cork.

The screwing operation serves to press the part 16 against the cork so as to transmit force at the moment of impact. In its region facing towards the cork 40, the impact part 16 may optionally present a recess 42 that is complementary in shape to the outside surface 44 of the cork so as to achieve a better distribution of stresses at the moment of impact.

Numerous variant embodiments can be envisaged, for example conserving a completely spherical shape for the impact part 16 and hollowing out the cork to form a recess of complementary shape. Furthermore, the screw 38 may be fastened to the body of the impact part 16 using numerous techniques other than the presence of an insert: the screw may go right through the part 16 and be tightened by means of a screwdriver, the part 16 may be molded onto a screw that is embedded therein, etc.

FIG. 4 shows the phenomena that occur at the moment of impact against the part 16 secured to the cork 40.

After releasing the wire-cap, if any, retaining the cork 40, the user strikes the part 16 with the iron 22 of the golf club 24, in a direction that is approximately horizontal (arrow 46), i.e. parallel to the plane of the podium (plane referenced 18) above which the impact part 16 projects. The movement could equally well be a circular swing, traveling tangentially to the podium at the moment of impact. The sudden impact of the front face 48 of the iron 22 against the spherical part 16 causes it to be expelled immediately, taking with it the cork 40 (arrow 50) and consequently opening the bottle with a content thereof gushing out spectacularly.

In the region of the strike, it is possible to provide a cover or fairing 52 serving to protect the neck of the bottle, so as to avoid the neck being broken by an ill-judged strike.

Figure 5:
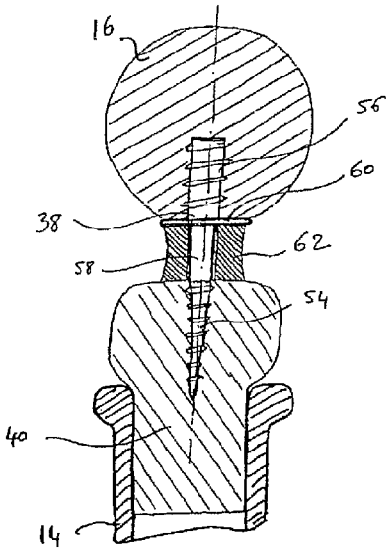
FIG. 5 is a section showing in detail one particular technique for securing the impact part to the cork.

FIG. 5 shows a variant of the FIG. 3 fastener system. Between its two threaded portions 54 and 56 the self-drilling double-threaded screw 38 includes a smooth shank portion 58 and a collar 60 situated between said smooth portion 58 and the threaded portion 56 that is inserted in the impact part 16.

This particular configuration enables a spacer 62 to be placed between the impact part 16 and the cork 40 so as to provide additional distance between these two parts while conserving an extremely rigid connection between them. The spacer-forming part 62 extends around the smooth central region 58 of the self-drilling screw 38, and it advantageously presents an outer profile that is slightly concave, reminiscent of a diabolo or of a golf tee. The spacer serves to withstand and transmit the violent forces at the moment of percussion by the striking surface, while also offsetting the impact part a little from the neck of the bottle so as to protect the neck in the event of an inaccurate strike.

Figure 6:
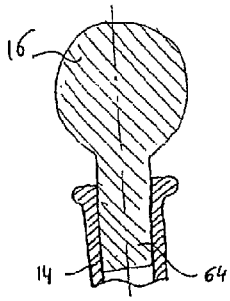
FIG. 6 shows a one-piece cork that incorporates the impact part.

FIG. 6 shows another configuration in which the cork and the impact part 16 are constituted by a single piece. For this purpose, the impact part 16 is extended in its portion directed towards the bottle 14 by a cylindrical portion 64 that is capable of closing the bottle in the same manner as a traditional cork.

Figure 7:
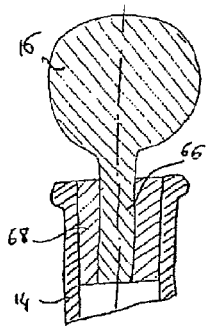
FIG. 7 shows a variant of FIG. 6 in which the cork is made as two coaxial portions.

FIG. 7 shows another variant in which the bottle is closed by a two-portion cork, comprising a central portion 66 secured to the impact part 16 (or integral therewith, as shown) and an external portion 68. The two portions 66 and 68 are coaxial and engaged by force one in the other, the assembly then being inserted in the neck of the bottle 14 so as to cork it. This type of two-portion cork makes it possible, at the moment of impact, to expel with the impact part 16 only the central portion 66, with the outer portion 68 remaining in the neck of the bottle 14. The orifice of the bottle therefore presents a diameter that is smaller than the diameter of the neck proper, and this smaller diameter (which would otherwise constitute more of a drawback for a bottle opened in the traditional manner) serving to maximize the spray of liquid at the moment the content is ejected after the cork has been expelled.

Figure 8:
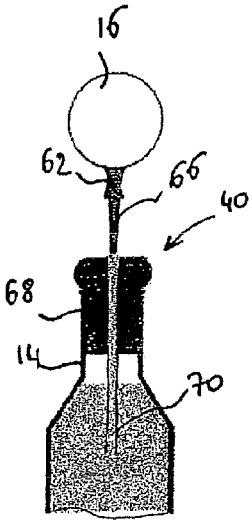
FIGS. 8 to 10 show yet more variant embodiments of the assembly comprising the cork and the impact part, designed in particular to maximize and control the spray of liquid when the bottle opens.
Figure 9:
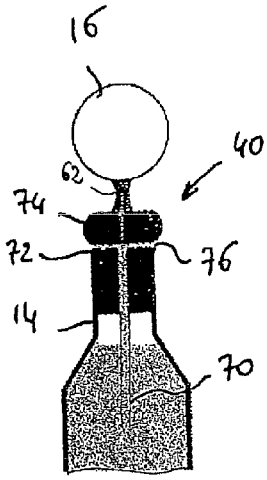
Figure 10:
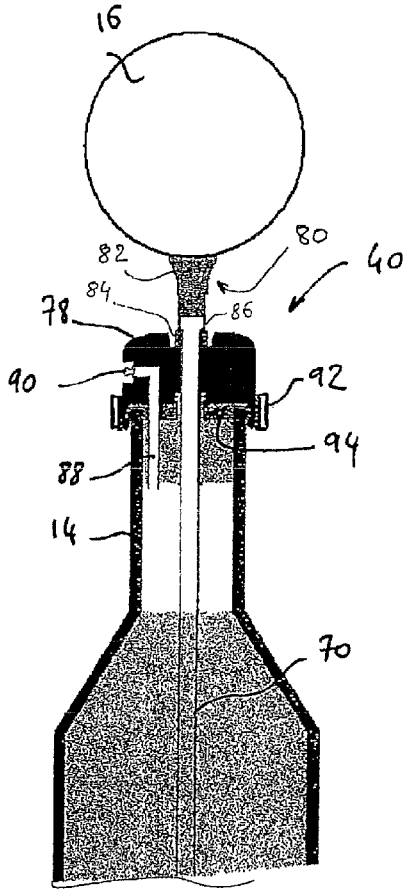

FIGS. 8 to 10 show still further variant embodiments of the assembly comprising the cork and the impact part, serving in particular to maximize and control the spray of liquid at the moment the bottle is opened.

In the embodiment shown in FIG. 8, as in FIG. 7, the cork is made in two portions, comprising a central portion 66 forced into an outer portion 68, in turn forced into the neck of the bottle. The central portion 66 is slightly conical in shape like the engagement cones of a machine tool, so as i) to obtain sufficiently strong adhesion to provide sealing while ii) making expulsion easy merely by striking.

After the assembly comprising the central portion 66 and the impact part 16 has been expelled, this configuration also makes it possible to have a liquid ejection orifice of relatively small diameter, thereby making it possible to increase the amplitude and the duration of the spray. This phenomenon may be further increased by providing an extender tube 70 that is secured to the portion 68 of the cork that remains in place after opening, so as to increase the quantity of liquid that can be ejected by drawing liquid from the bottom of the bottle.

In the variant of FIG. 9, the cork 40 comprises two portions 72 and 74 that are connected together by a "fuse" 76, i.e. an element that can be broken or torn under the effect of striking against the impact part. The portion 72 that is inserted in the neck of the bottle remains secured to the bottle even after expulsion. It is provided with an axial through orifice so as to put the volume inside the bottle into communication with the outside once the portion 74 has been expelled. Advantageously, this orifice is extended by a dip tube 70 that performs the function explained with reference to FIG. 8.

The portion 74 of the cork, outside the neck, is secured to the impact part 16 in such a manner as to be capable of separating from the internal portion 72 after the fuse element 76 has torn at the moment of impact. This tearing into two portions releases the central orifice of the portion 72, thereby enabling the liquid contained in the bottle to be ejected.

FIG. 10 shows yet another embodiment, intended in position for a reusable device.

For this purpose, the cork 40 comprises a stationary portion 78 that is secured to the bottle 14 and that is designed to remain secured thereto after opening, and a second portion 80 for single use only, that can be replaced so as to enable the remainder of the assembly to be reused.

More precisely, the second portion 80 comprises a first zone 82, e.g. in the form of a golf tee, that is secured to the impact part 16. At the opposite end, a region 84 is designed to be secured to the first portion 78 of the cork, e.g. by mutual engagement (if deformable materials are used) or by screw fastening (if rigid materials are used). The regions 82 and 84 are connected together by a breakable region 86 constituting a fuse, and performing the same function as the element 76 described with reference to FIG. 9.

Advantageously, the assembly also has a tube 88 passing through the stationary first portion 78 of the cork 40 and enabling the top portion of the inside volume of the bottle 14 to be put into communication with the outside via a closing check valve 90. In order to achieve good sealing, the stationary portion 78 of the cork is secured to the neck of the bottle by a collar 92 enabling a sealing gasket 94 that is interposed between the free edge of the neck of the bottle and the inside of the portion 78 of the cork 40 to be put under compression.

This configuration enables the inside volume of the bottle to be connected to an external pressure source, e.g. a compressor situated in the podium, thus making it possible to control the pressure inside the bottle continuously, even while the liquid is being expelled. The pneumatic circuit, that includes the usual regulator means, then makes it possible during this stage to conserve a pressure that is substantially constant inside the volume of the bottle.

This technique makes it possible to manage on demand the quality, the power, the diameter, and the duration of the spray of liquid, by acting on the pressure delivered by the compressor, the size of the ejection orifice, and the quantity of liquid contained in the bottle.

The invention claimed is:

1. A method of force expulsion of a cork closing a bottle, in particular a bottle of champagne or the like, by applying a sudden force to the cork, the method being characterized by the following successive steps:

a) securing an impact part (16) to the body of the cork (40) so as to extend the cork axially from the bottle;

b) orienting and holding the bottle (14) in a predetermined position so that the bottle extends essentially below a reference level (18), with the impact part emerging above said level, wherein the bottle is oriented in such a manner that the main axis of the bottle forms an angle lying in the range 90° to 45° relative to the strike direction of a striker surface against the impact part; and c) striking the impact part with the striker surface (22) in such a manner as to produce a force of sufficient amplitude to forcibly expel the cork solely by the fact of the striker surface striking against the impact part.

2. The method of claim 1, wherein said striker surface (22) is situated at the end of the arm of a striker accessory (24).

3. The method of claim 2, wherein said striker accessory (24) used in step c) is an accessory of the golf club type.

4. The method of claim 1, wherein, in step b) the bottle is oriented so that its main axis is essentially perpendicular to the strike direction of the striker surface against the impact part.

5. The method of claim 1, wherein the impact part (16) presents a shape that is essentially spherical.

6. An assembly for forcible expulsion of a cork closing a bottle, in particular a bottle of champagne or the like, by applying a sudden force to the cork, the assembly being characterized in that it comprises:

an impact part (16) suitable for axially extending the cork of the bottle and including means (36, 38) for securing it to the body of the cork (40); and a bottle support, comprising:

a podium (10) defining a reference level (18); and means (30) for orienting and holding the bottle (14) in a predetermined position such that it extends substantially below said reference level, with the impact part emerging above said level, wherein the bottle is oriented in such a manner that the main axis of the bottle forms an angle lying in the range 90° to 45° relative to a strike direction of a striker surface against the impact part.

7. The assembly of claim 6, further comprising:

a striker accessory (24) comprising an arm and a striker surface (22) situated at the end of the arm.

8. The assembly of claim 7, wherein the striker accessory (24) is an accessory of the golf ball type.

9. The assembly of claim 6, wherein the impart part (16) presents a shape that is essentially spherical.

10. The assembly of claim 6, wherein the means for securing the impact part (16) to the body of the cork (40) comprise a self-drilling axial screw (38).

11. The assembly of claim 10, further comprising a spacer (62) placed between the impact part (16) and the body of the cork (40) around an intermediate region (58) of the self-drilling axial screw (38).

12. A system for forcible expulsion of a cork closing a bottle, in particular a bottle of champagne or the like, by applying a sudden force to the cork, the system being characterized in that it comprises:

the cork;

the bottle;

an impact part (16) suitable for axially extending the cork of the bottle and including means (36, 38) for securing it to the body of the cork (40); and a bottle support, comprising:

a podium (10) defining a reference level (18); and means (30) for orienting and holding the bottle (14) in a predetermined position such that it extends substantially below said reference level, with the impact part emerging above said level.

13. The assembly of claim 6, further including external means for pressurizing the volume inside the bottle.

14. The system of claim 12, wherein the impact part (16) and the cork (64) are made as a single piece.

15. The system of claim 12, wherein the cork (40) is made as two coaxial portions, comprising an outer portion (68) in contact with the neck of the bottle and an inner portion (66) suitable for being secured to said impact part (16).

16. The system of claim 12, wherein the cork (40) is made in two portions (72, 74; 78, 80) that are separated by a breakable element (76; 86) with a stationary first portion (72, 78) secured to the neck of the bottle and a second portion (74, 80) suitable for being secured to said impact part (16) in order to be ejected together therewith.

17. The system of claim 16, including between said breakable element (86) and said first portion (78), a region (84) that includes means for securing to said first portion (78).

* * * * *